US005928764A

United States Patent [19]

Costi

[11] Patent Number: 5,928,764

[45] Date of Patent: Jul. 27, 1999

[54] COVERING MATERIAL

[75] Inventor: Albert Costi, Tavarnelle Val Di Pesa, France

[73] Assignee: Onduline, Paris, France

[21] Appl. No.: 08/968,427

[22] Filed: Nov. 12, 1997

[30] Foreign Application Priority Data

Nov. 12, 1996 [FR] France ..... 96 137 66

[51] Int. Cl.[6] ..... B32B 3/28; E04D 1/00

[52] U.S. Cl. ..... 428/182; 428/141; 428/156; 428/183; 428/184; 52/537

[58] Field of Search ..... 428/184, 183, 428/182, 59, 141, 131, 167, 156; 52/41, 90.1, 518, 519, 537, 409

[56] References Cited

U.S. PATENT DOCUMENTS

| | | | |
|---|---|---|---|
| 1,444,397 | 2/1923 | Seigle | 428/183 |
| 1,987,798 | 1/1935 | Rupprecht | 428/183 |
| 2,253,718 | 8/1941 | McKeage | 428/183 |
| 2,503,847 | 4/1950 | Ives | 428/167 |
| 2,642,372 | 6/1953 | Chittick | 428/183 |
| 5,384,177 | 1/1995 | Rissmann | 428/182 |

FOREIGN PATENT DOCUMENTS

| | | |
|---|---|---|
| 977158 | 3/1951 | France . |
| 1509219 | 12/1967 | France . |
| 2 249 223 | 5/1975 | France . |
| 2 260 676 | 9/1975 | France . |
| 2 594 160 | 8/1987 | France . |
| 613846 | 12/1948 | United Kingdom . |

*Primary Examiner*—Donald Loney
*Attorney, Agent, or Firm*—Young & Thompson

[57] ABSTRACT

A covering material having corrugations and having on one of its surfaces, hollowed areas (3) in the convex part (10) of the corrugations (2) for laying tiles.

12 Claims, 6 Drawing Sheets

COVERING MATERIAL

FIELD OF THE INVENTION

This invention relates to a covering material. This material can constitute a light weight roof or can be used to make an under-roof intended for a roof made with round tiles, with or without tenons or with flat tiles called "Marseilles Tiles".

BACKGROUND OF THE INVENTION

Under-roofs produced in profiled materials are known, particularly corrugated materials that also have, in certain cases, alternating corrugations and flat areas. FR Patent 2 496 551 describes materials of this type.

Such a profiled material can also be used to produce light weight roofs.

Furthermore, corrugated under-roof materials are more particularly intended for arched tiles. They have good qualities since they make the roof leak-tight, even if a tile is displaced or broken, and they guarantee natural ventilation of the roof.

This is why, corrugated panels have also been used to produce under-roofs intended for roofs with flat tiles.

In order to be able to lay flat tiles, it is necessary to first fix battens onto the under-roof, the battens being used as the hanger for the tiles.

Fixing battens onto corrugated panels does however have disadvantages. In particular, the weight of the battens and the tiles is almost entirely supported by the summits of the corrugations which have a tendency to deform.

This weakens the under-roof. Moreover, the deformation of the under-roof can impair good ventilation of the roof and prevent the run-off of water that has possibly infiltrated through a damaged tile.

That is why members have been designed to support and to distribute the loads, these members being intended to be placed between the battens and the under-roof, at specified intervals.

In this regard, FR patent 2 658 848 may be mentioned which describes a support and load distribution member consisting of a tubular crosspiece arranged in a concave corrugation of the under-roof. Such a member permits good distribution of the loads and does not prevent the passage of air for the ventilation of the roof.

However, the presence of battens and support and load distribution members extends the time taken to produce roofs and has a not insignificant effect on their cost. They may also block, at least in part, the passage of air between the tiles and the under-roof, as well as the run-off of water.

It is furthermore, desirable to simplify the production of roofs with flat tiles.

It has also appeared necessary to make the profiled materials more rigid, whether they are intended for use as a roofing material or as an under-roofing material, in order to extend the life of the roof.

SUMMARY OF THE INVENTION

Hence the invention relates to a covering material having corrugations and comprising, on one of its surfaces, hollowed areas in the convex part of the corrugations.

These hollowed areas permit the hanging of flat tiles directly onto the under-roofing material. The presence of battens and support and load distribution members is hence made unnecessary.

The saving in timber is estimated to be about 70% of the total cost.

Preferably, the ratio between the amplitude of the corrugations and their pitch is between about 1/2 and 1/1.

This covering material then has deeper corrugations which increases its resistance to bowing and the rigidity of roofs in which it is used, whether it is used as an under-roof or directly to produce a light weight roof These deep corrugations also allow improved drainage.

The hollowed areas are advantageously distributed along straight lines substantially perpendicular to the corrugations.

Furthermore, on the area of the material intended to receive the tiles, the summit of the convex part of the corrugations is, preferably, slightly flattened.

This allows a larger contact area to be provided between the flat tiles and the summit of the corrugations and hence avoids any risk of deformation of the under-roof and slippage of the tiles.

Advantageously, the material has a rough surface condition on the summit of the convex part of the corrugations.

This contributes to avoiding slippage of tiles.

In order to produce under-roofs for arched tiles, the covering material advantageously has alternating flat areas and corrugations. The flat areas allow better fixing of the standard tiles or the covering tiles, when the standard tiles are done away with.

This material is more particularly intended for the creation of roofs with flat tiles. It then constitutes an under-roof that directly supports the flat tiles. The tenon of each flat tile is received by a hollowed area in the material.

BRIEF DESCRIPTION OF THE DRAWINGS

Other advantages, aims and characteristics of the invention will become more clearly apparent on reading the following description in conjunction with the appended drawings showing non-limitative examples of the invention and in which.

DETAILED DESCRIPTION OF THE PREFERRED EMBODIMENT

Elements common to the different figures will be designated with the same reference numbers.

Figure 1:
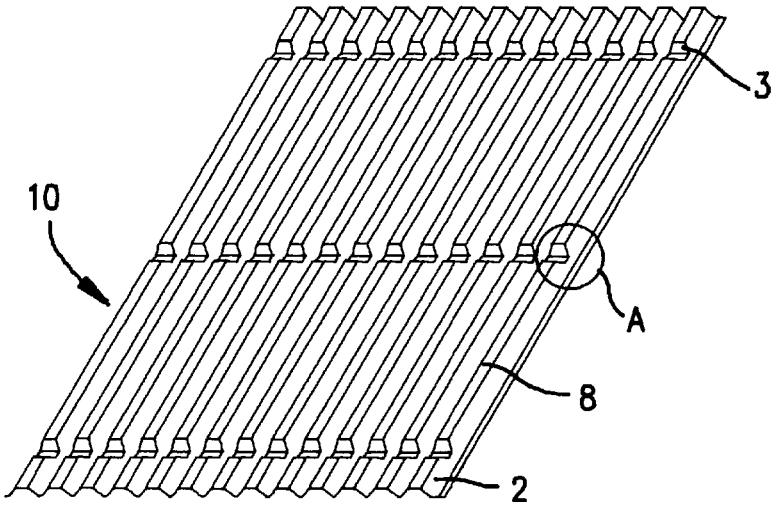
FIG. 1 is a perspective view of a covering material according to the invention.
Figure 3:
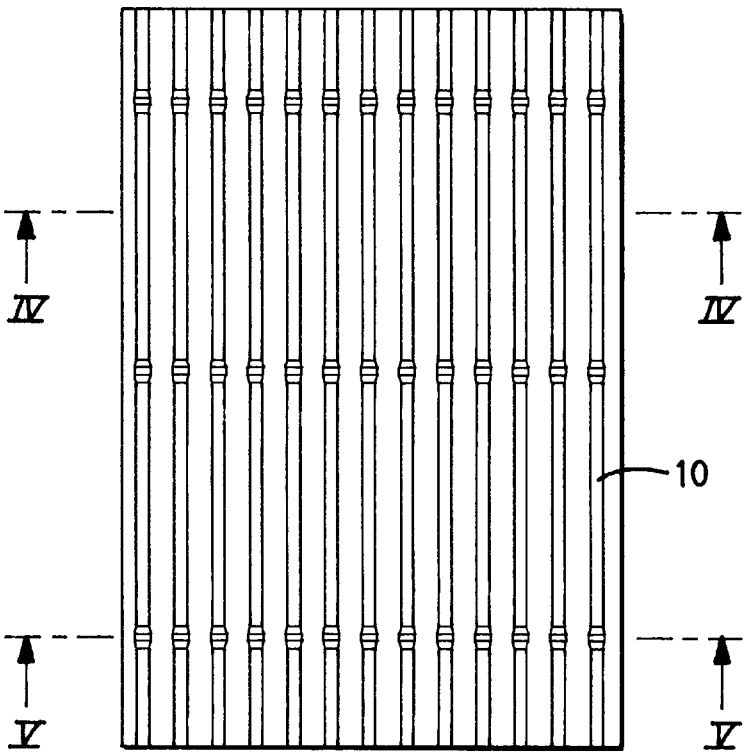
FIG. 3 is a view from above of a covering material according to the invention.
Figure 2:
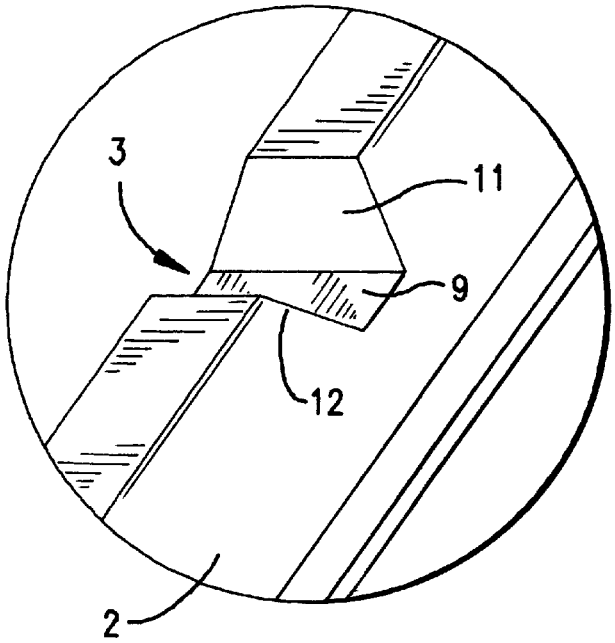
FIG. 2 represents, in an enlarged view, the detail A of FIG. 1

With reference to FIG. 1, the covering material 1 has the shape of a corrugated sheet. The profile of the sheet is a regular substantially sinusoidal corrugation. It could also have alternating corrugations and flat areas. Furthermore, the corrugations could be different, for example Grecian type or V-shaped.

The covering material illustrated in FIG. 1 is more particularly intended for the making of an under-roof for a roof with flat tiles.

It comprises, on its surface intended to receive the tiles, hollowed areas 3 which are made on the convex part 10 of each corrugation 2 and distributed along straight lines parallel to each other and perpendicular to the corrugations 2.

Figure 6:
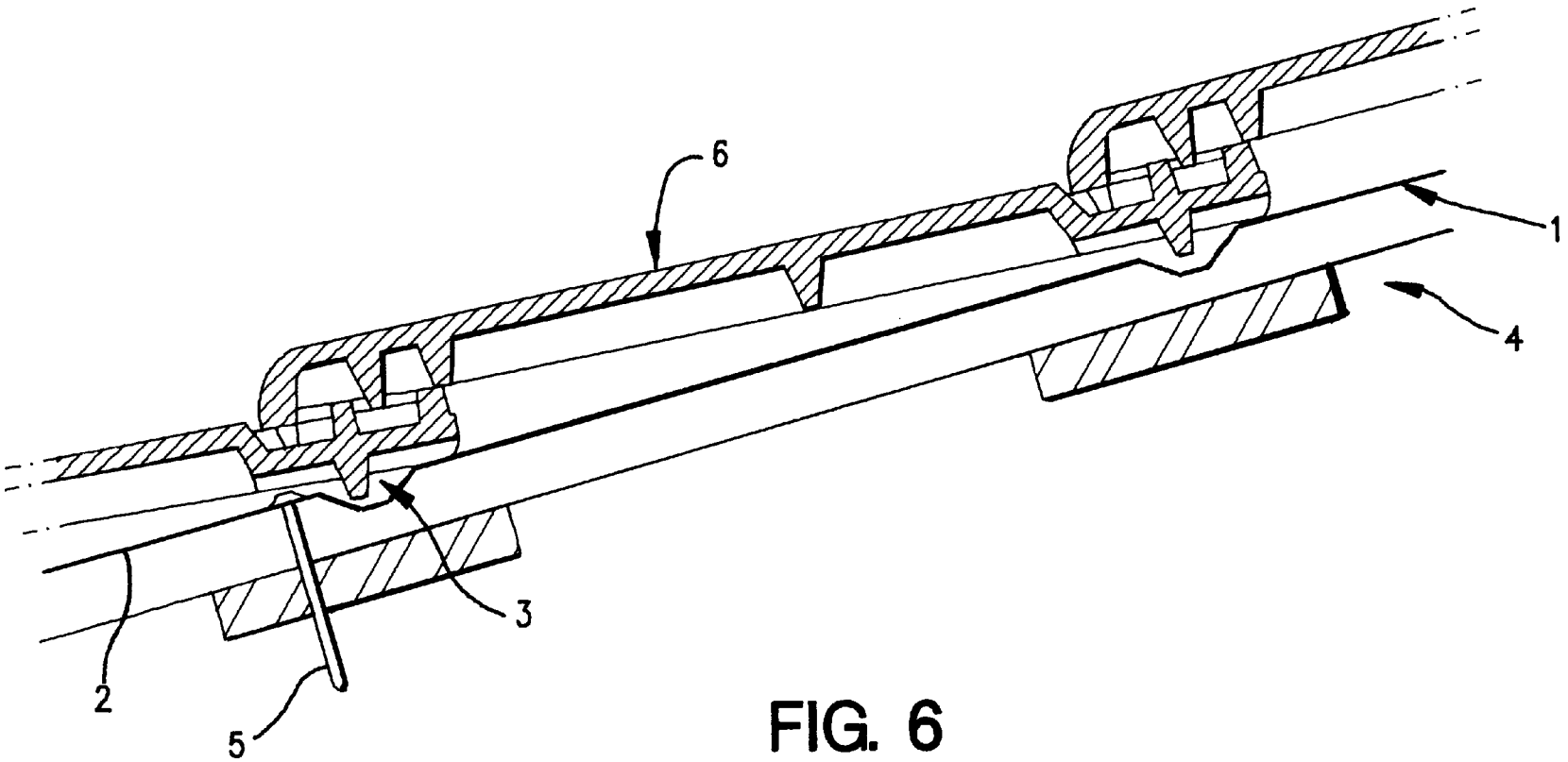
FIG. 6 is a partial view, in cross-section, of a roof made with a covering material according to the invention and flat tiles along the slope of the roof.

As shown in FIG. 6, these hollowed areas allow flat tiles to be laid directly onto the corrugated sheet 1. Their depth is chosen therefore in order to be able to receive and to retain the tenons 7 of the tiles 6. The bottom 9 thereof is preferably flat. The upper and lower faces of these hollowed out areas are advantageously inclined in relation to the bottom 9, these inclinations being advantageously symmetrical with respect to a plane perpendicular to the bottom of these areas.

The distance between the hollowed areas is matched to the type of tiles used for the roof.

The roof is then made in the following way:

Corrugated sheets like the sheet 1, are fixed onto the timber-work 4 in such a way that they partially cover one another and that the corrugations 2 are positioned along the slope of the roof. Any appropriate means 5 of fixing, positioned preferably on the summit of the corrugations can be used.

The flat tiles 6 are then directly placed onto the under-roof formed by the corrugated sheets, the hollowed areas 3 receiving the tenons 7.

The hollowed areas prevent slippage of the tiles, the battens being done away with. They also simplify the work of the roofer, since they ensure perfect alignment without recourse to a line.

Figure 4:
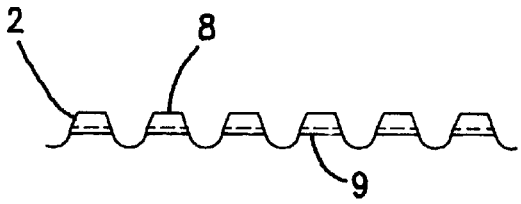
FIG. 4 is a section through IV—IV of FIG. 3.
Figure 5:
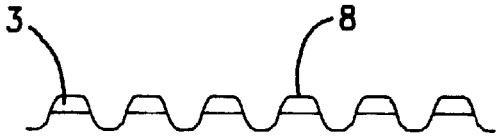
FIG. 5 is a section through V—V of FIG. 3.

In addition, the summit 8 of the corrugations 2 is, preferably, slightly flattened and the material 1 has a semi-trapezoidal profile, as illustrated by FIGS. 4 and 5.

This profile reinforces the strength of the material according to the invention and provides a large contact surface between the flat tiles and the summit of the corrugations. In particular, the material is not deformed when one walks upon it, it bears the weight of the tiles and supports the roof perfectly.

In order to improve the laying of the tiles onto the material, it advantageously comprises a rough surface condition on the summit 8 of the convex part 10 of the corrugations 2.

Advantageously, the ratio between the amplitude of the corrugation and the pitch of the corrugations is between about 1/2 and 1/1. By way of comparison, the amplitude/pitch ratio for a traditional profiled material is 36/95 or about 1/2.6.

The amplitude of the corrugation is hence, for a defined pitch, greater than that of a traditional corrugated sheet, of the type described in FR patent 2 496 551. The resistance to bowing of the sheet is hence also increased.

By way of example, when the amplitude/pitch ratio increases about 5.5%, the inertia of the material increases by 15.5%.

In a material according to the invention, the amplitude of the corrugation will be, for example, 24 mm and the pitch 49 mm, for a thickness of between 2 and 3 mm.

A suitable rough surface condition will be able to be created by embossing. Good results have been obtained with bumps of a few tenths of a millimeter high having a base inscribed within a circle of diameter between 0.1 to 0.9 mm. These bumps advantageously are from 1 to 100 per $cm^2$ ($10^{-4}$ $m^2$) in number.

The covering material 1 is hence more rigid, whether it is used to create a light weight roof, with a suitable finishing surface, or to form an under-roof, for a roof with flat or with arched tiles.

The covering, material according to the invention can, for example, be produced in a cellulose material impregnated with bitumen, in a plastic material, of the PVC type or in steel. The covering materials made in plastic have better dimensional stability and improved resistance to moisture.

The covering material is advantageously manufactured with of a corrugating machine that forms the corrugations then a reprofiling machine for the formation of the hollowed areas.

Figure 7:
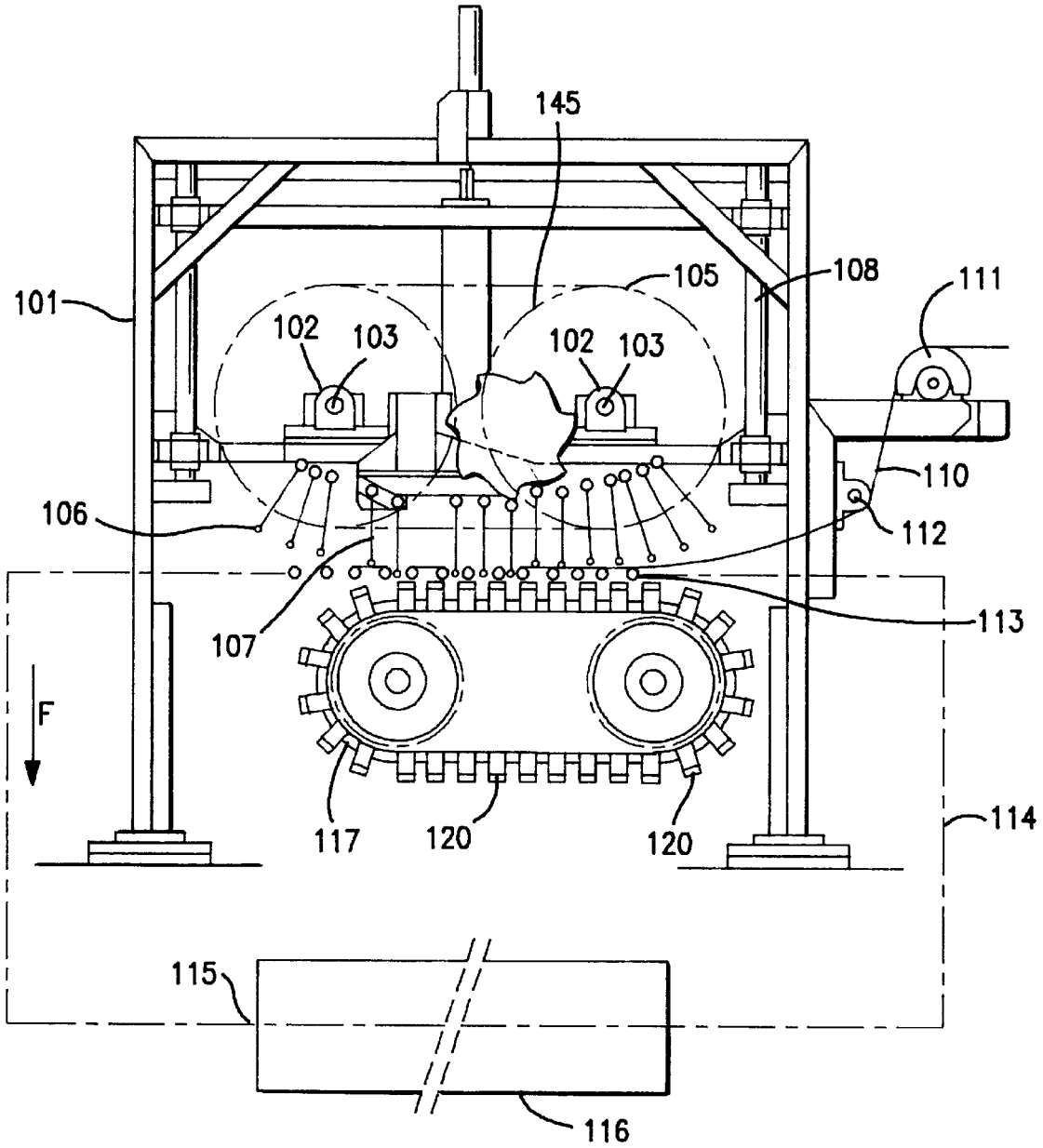
FIG. 7 represents a diagrammatic view of an example of a corrugating machine for the corrugation of the covering material of the invention.

Referring to FIG. 7, the machine for corrugating the covering material of the invention comprises a frame 101 within which corrugating bars 106 are mounted.

The material to be corrugated 110 comes from a system not shown on the Figure. It is guided by suitable means 111 and 112 onto the bars 113 of the dryer chain 114.

It is generally made up of a sheet of malleable material such as moist cardboard or felt.

At the exit to the corrugating machine, the profiled material is lead to the entry 115 to the drying tunnel 116. When it leaves the drying chamber, the profiled material is removed from the bars of the dryer. The direction of circulation of the material on the dryer chain 114 is shown by the arrow F.

Within the frame 101, two bearings 102 are mounted. A shaft 103, rotatably driven by a motor not represented in the Figure, passes through each of the bearings. The shafts 102 are parallel and rotatably drive an endless chain 105, by means of transmission units 145.

The corrugating bars 106 are fixed onto the chain by means of a support 107. They are movable in translation with respect to the plane of the chain, as will be described in greater detail with reference to FIG. 8.

Preferably, the assembly made up by the endless chain 105 and the corrugating bars 106 is fixed onto a sub-frame 108 itself fixed to the frame 101. The sub-frame is slidably mounted on slides.

This allows the distance between the corrugating bars 106 and the dryer bars 113 to be adjusted.

Underneath the dryer bars, the corrugating machine preferably comprises another endless chain 117. This is rotatably driven by means of two shafts 118 supported by bearings 119, fixed onto the frame 101. The shafts 118 are parallel to the shafts 102.

Reinforcing bars 120 are fixed onto chain 117 parallel to the dryer bars.

Figure 8:
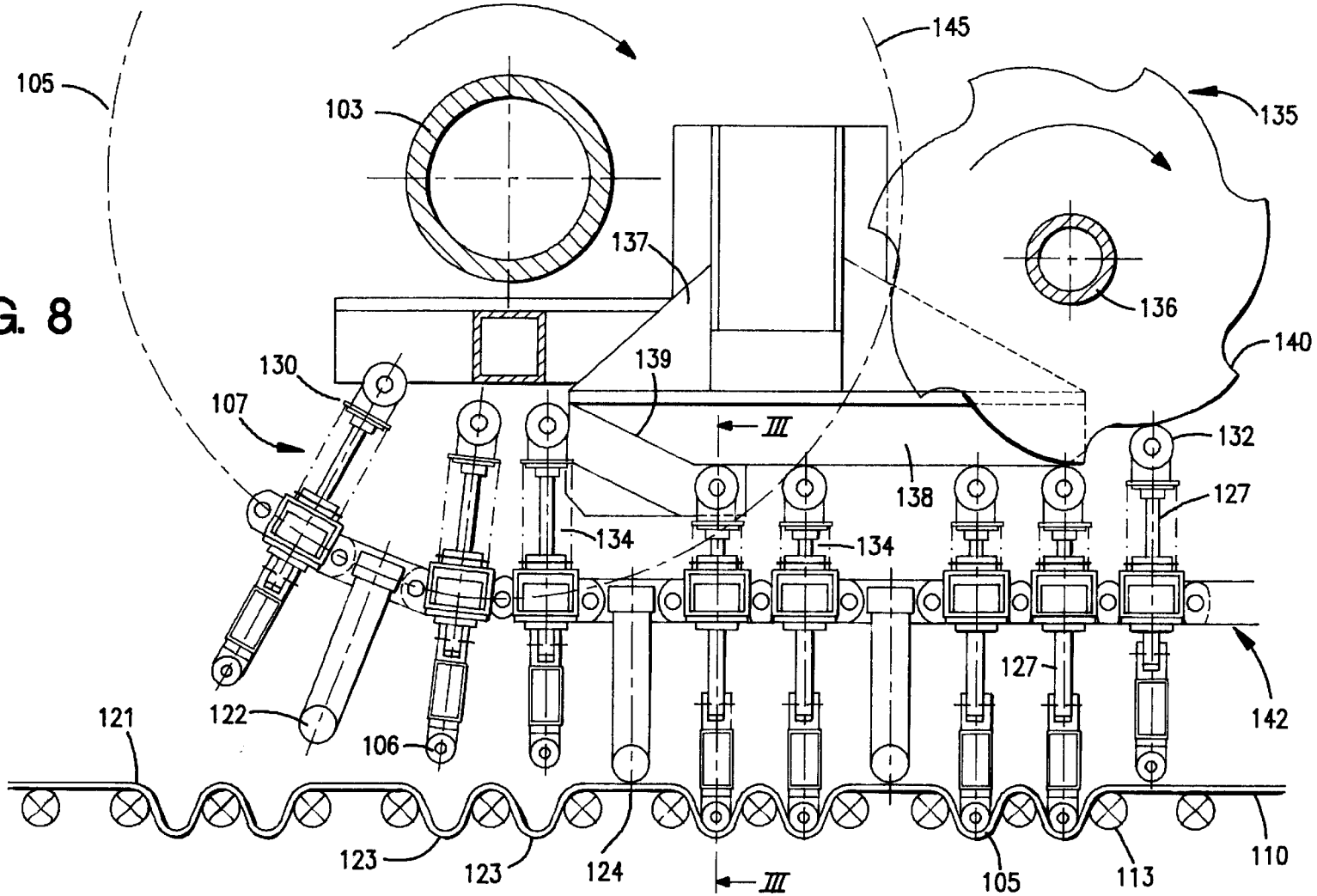
FIG. 8 is a partial cross-section view of an example of the machine in FIG. 7, along a plane perpendicular to the corrugations formed.

With reference to FIG. 8, the sheet 110 of material to be corrugated is supported by the bars 113 of the dryer chain. It is converted between the corrugating bars 106 and the bars 113. The material 121 which leaves the corrugating machine has a profile corresponding to the machine and to the adjustment of the corrugating bars.

In the example illustrated in FIG. 8, the corrugating machine comprises, alternately, two corrugating bars 106 with a round section and a to holding rod 122. As will be seen later, the holding rods allow the flat areas to be formed. Hence the material 121 is made up of alternately two corrugations 123 and a flat area 124.

The operation of the corrugating machine is as follows:

The sheet 110 of material to be corrugated is supplied continuously and is positioned on the dryer bars 113 which also pass along continuously on the dryer chain 114.

A corrugating bar 106 is brought along by the endless chain 105 into the part 142 of the chain 105 where it is opposite the plane of the support bars. Support 107 of the corrugating bar is then perpendicular to the plane the dryer bars 113. The corrugating bar is in a high position and is not in contact with the material to be corrugated. It then comes opposite a projection 140 of the cam, which presses on the member 132.

Because of the rotation of the cam 135 about the axis 136, the projection 140 pushes the movable member 127 of the corrugating bar support. The corrugating bar is then subjected to translation, perpendicular to the plane of the endless chain and to the plane of the support bars and moves to the low position.

The displacement of the chain 105 of corrugating bars and that of the dryer chain 114 are regulated with respect to one another, in such a way that a corrugating bar is located in the low position between two dryer bars. The movement of the clevis 130 compresses the elastic means 134.

Before the contact between the member 132 of the corrugating bar support and the projection 140 comes to an end because of the rotational movement of the cam 135, the running gear 132 comes into contact with the slide 137, the corrugating bar being carried by the endless chain 105 in the direction of travel of the material to be corrugated.

The corrugating bar 106 is then held in the low position so that the running gear 132 is in contact with the first area 138 of the slide, parallel to the plane of the dryer bars 113.

Then the running gear 132 is engaged in the second area 139 of the slide. At the exit from this second area, the corrugating bar 106 is once again in the high position.

The pressure on the member 132 being released, the spring 134, previously compressed, distends. The movable member 127 is then subjected to a translation movement which moves it away from the plane of the dryer bars 113. The movement causes the corrugating bar to go back up and it is then disengaged from the bars of the dryer between which it had gone.

The corrugating bar is then driven by the endless chain.

The positions of the cam 135 and the slide 137 are, preferably, selected in a way that keeps the corrugating bars 106 in contact with the material to be corrugated, as long as the chain 105 is parallel to the plane of the dryer bars.

This allows easy retraction of the corrugating bars, the support of which is perpendicular to the plane of the dryer, while at the same time keeping the corrugating bars in contact with the material to be corrugated for a sufficiently long time to form the profile in a stable way and to reduce stresses.

Figure 9:
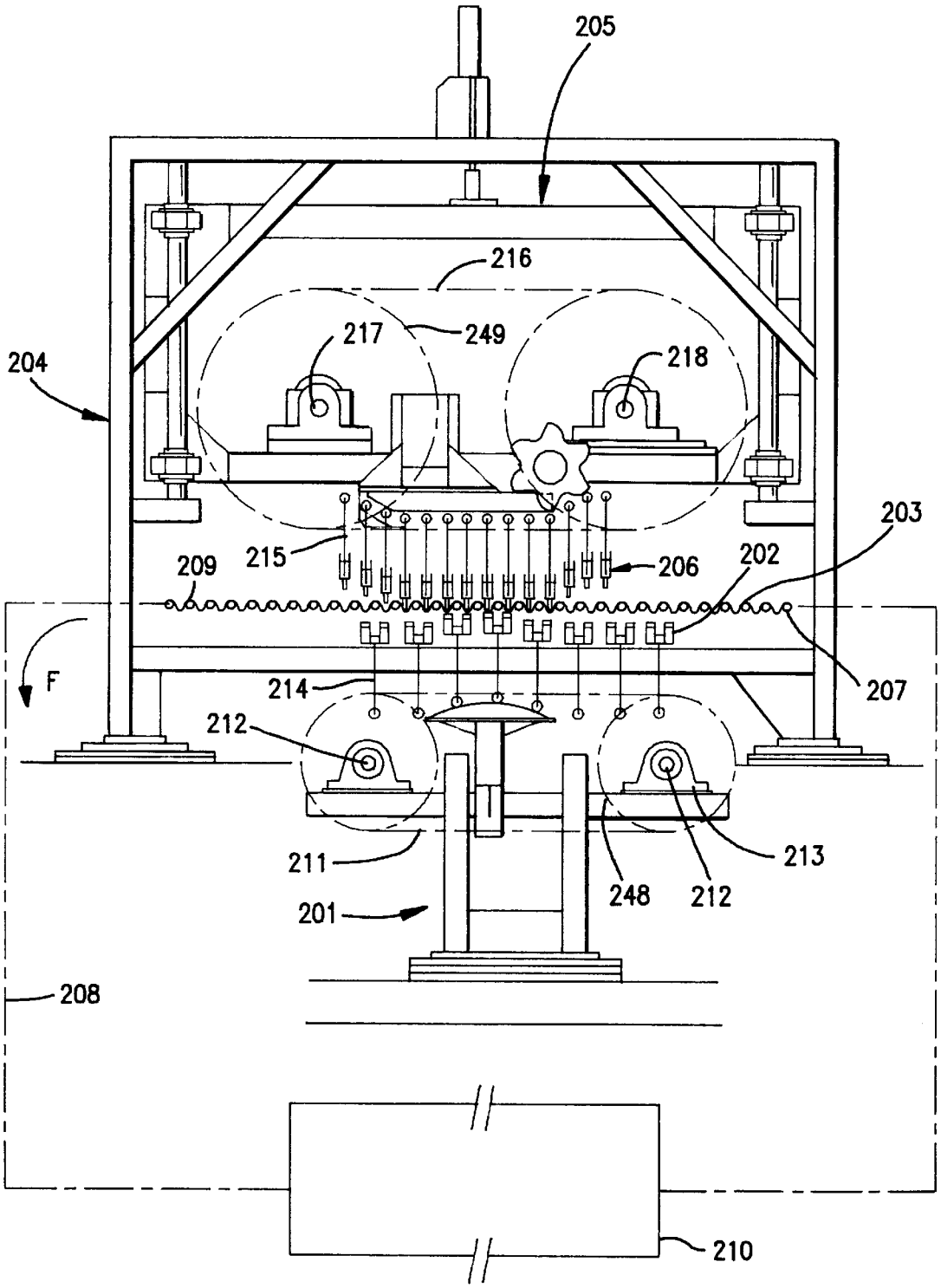
FIG. 9 is a diagrammatic view of an assembly of an example of the machine for reprofiling the covering material of the invention.

Referring to FIG. 9, the reprofiling machine for the covering material of the invention comprises a first frame 201, that supports bars 202 used as formers to reprofile a material previously corrugated 203.

The machine also comprises a second frame 204, on which a block 205 is mounted that supports bars 206 used as counter-formers.

The block 205 is slidably mounted on slides fixed to the frame 204. This allows adjustment of the distance between the reprofiling bars 202 and the counter-forming bars 206.

The material is generally made up of wet cardboard, felt or any other malleable material.

The material is brought onto the support bars 207 by a device not shown on the Figure. The bars are, preferably, those of the dryer chain 208.

This solution has the advantage of avoiding manipulation of materials 209 which come out of the reprofiling machine wet, before they go into the dryer tunnel 210.

This limits the risk of damaging the product and reduces handling costs.

The materials are removed from the support bars 207, when they leave the dryer 210. The direction of circulation of the materials 209 on the dryer chain 208 is shown by the arrow F.

Generally speaking, each reprofiling bar 202 is fixed, by means of a support 214, onto an endless chain 211, rotatably driven by two parallel shafts 212 by means of transmission units 248.

The shafts are mounted in bearings 213 fixed to the frame 201.

The reprofiling bars 202 are parallel to the shafts 212. The supports 214 are, in the example shown, perpendicular to the chain 211 and movable in translation with respect to the chain.

Similarly, the counter-forming bars are fixed, by means of a support 215, onto an endless chain 216, rotatably driven by two parallel shafts 217, by means of transmission units 249.

The shafts 217 are mounted in bearings 218 fixed to the frame 201. The counter-forming bars 206 are parallel to the shafts 218. The supports 215 are, in the example shown, perpendicular to the chain 216 and movable in translation with respect to this chain.

The reprofiling and counter-forming bars are, furthermore, parallel to the bars 207 of the dryer.

It must be emphasised that the profile of the material according to the invention allows good ventilation of the roof, the water vapour being able to circulate easily.

We claim:

1. A corrugated roof support material, comprising a roofing sheet with parallel corrugations of peaks and valleys, said peaks having plural hollow means for receiving roofing tile tenons therein, said hollow means being aligned across said peaks substantially perpendicular to the corrugations, and wherein a ratio of an amplitude of the corrugations to a pitch of the corrugations is from 1:2 to 1:1.

2. The roof support material of claim 1, wherein said plural hollow means comprise concavities that are spaced apart by a center-to-center distance greater than a distance encompassed by at least five of said peaks measured in a direction perpendicular to the corrugations.

3. The roof support material of claim 1, wherein each of said hollow means comprises a planar bottom and planar sides which slope away from a center thereof.

4. The roof support material of claim 3, wherein said peaks are planar and said valleys are rounded so that said planar sides are trapezoid-shaped.

5. The roof support material of claim 1, wherein said sheet has a roughened surface comprising bumps which have a height of from one to nine-tenths of a millimeter and which have a density of from one to one hundred per one hundred square centimeters.

6. A corrugated roofing material, comprising a roofing sheet with parallel corrugations of peaks and valleys, said peaks having plural hollowed areas therein which are aligned across said peaks substantially perpendicular to the corrugations and which are spaced apart by a center-to-center distance greater than a distance encompassed by at least five of said peaks measured in a direction perpendicular to the corrugations, wherein each of said hollowed areas has a planar bottom and planar sides which slope away from a center thereof, and wherein said peaks are planar and said valleys are rounded so that said planar sides are trapezoid-shaped.

7. The roofing material of claim 6, wherein a ratio of an amplitude of the corrugations to a pitch of the corrugations is from 1:2 to 1:1.

8. A roof comprising:

plural overlapping tiles, each with a tenon on a bottom thereof;

a corrugated roofing sheet for supporting said tiles and having parallel corrugations of peaks and valleys, said peaks having plural hollowed areas therein in which said tenons rest, said hollowed areas being aligned across said peaks substantially perpendicular to the corrugations and spaced apart in a direction parallel to the corrugations by a distance that is the same as a distance between said tenons of adjacent ones of said overlapping tiles, and wherein a ratio of an amplitude of the corrugations to a pitch of the corrugations is from 1:2 to 1:1.

9. The roof of claim 8, wherein said peaks are planar and said valleys are rounded.

10. The roof of claim 9, wherein each of said hollowed areas has a planar bottom and planar sides which slope away from a center thereof so that said planar sides are trapezoid-shaped.

11. The roof of claim 8, wherein said hollowed areas are spaced apart by a center-to-center distance greater than a distance encompassed by at least five of said peaks measured in a direction perpendicular to the corrugations.

12. The roof of claim 8, wherein said tiles each have a substantially planar top surface.

* * * * *